US010286295B1

(12) United States Patent
Wilcox

(10) Patent No.: US 10,286,295 B1
(45) Date of Patent: May 14, 2019

(54) LOTTERY TICKET SCRATCHING TOOL

(71) Applicant: Thomas J. Wilcox, Madeira Beach, FL (US)

(72) Inventor: Thomas J. Wilcox, Madeira Beach, FL (US)

( * ) Notice: Subject to any disclaimer, the term of this patent is extended or adjusted under 35 U.S.C. 154(b) by 0 days.

(21) Appl. No.: 15/994,801

(22) Filed: May 31, 2018

(51) Int. Cl.
*A63F 3/06* (2006.01)
*B08B 1/00* (2006.01)
*A46B 13/00* (2006.01)

(52) U.S. Cl.
CPC ..... *A63F 3/068* (2013.01); *A46B 13/001* (2013.01); *B08B 1/005* (2013.01)

(58) Field of Classification Search
CPC ..... A63F 3/068; A46B 13/001; B08B 1/005
See application file for complete search history.

(56) References Cited

U.S. PATENT DOCUMENTS 5,794,303 A * 8/1998 Sanfilippo ..... A47L 5/26 15/339
6,065,181 A * 5/2000 Cleveland ..... A47L 5/26 15/344
7,465,359 B2 * 12/2008 Vives-Martinez ..... A63F 3/068 134/21
2005/0144753 A1 * 7/2005 Pulliam ..... A47L 9/06 15/401
2009/0126135 A1 5/2009 Gilmore
2011/0099746 A1 * 5/2011 Brown ..... A47L 5/24 15/344
2017/0021267 A1 * 1/2017 Kessinger ..... A63F 3/068

* cited by examiner

*Primary Examiner* — David Redding
(74) *Attorney, Agent, or Firm* — Sanchelima & Associates, P.A.; Christian Sanchelima; Jesus Sanchelima

(57) ABSTRACT

The present invention is a lottery ticket scratching tool for scraping off the lottery tickets. The lottery ticket scratching tool includes a main body having an electric motor to generate vacuum therein. The lottery ticket scratching tool also includes a scraping blade provided at one end of the main body. As the scraping blade is used to scrape the lottery ticket, the resulting scraped off debris material is sucked into the main body to be discarded later. The lottery ticket scratching tool includes a fine mesh to prevent debris material from impinging on the electric motor, and also a one-way valve to keep the collected debris material within the main body. The lottery ticket scratching tool is battery operated to be portable and for easier handling thereof.

10 Claims, 2 Drawing Sheets

LOTTERY TICKET SCRATCHING TOOL

BACKGROUND OF THE INVENTION

1. Field of the Invention

The present disclosure generally relates to a scratching tool, and more particularly to a scratching tool with a vacuum source which, among other uses, is primarily used for scratching off and suctioning covering material scraped off from a lottery ticket.

2. Description of the Related Art

Various lotteries employ a "scratch-off" game in which a user is given a paper ticket with a certain area covered with an opaque covering material, such as a metallic or latex material, which is used to block the identifying information of such lottery tickets. The user has to remove the opaque material to reveal whether the ticket is a winning ticket. Generally, the user resort to using his/her nails for scratching away the opaque material on such lottery tickets. This could potentially damage nails and/or may lead to accumulation of debris of the scraped material inside the nails, which is not desired and may further be unhygienic. Further, use of nails or other commonly employed objects like coins could possibly destroy the paper ticket and thus the underlying information, which could potentially be a huge loss for the user. Furthermore, these scratch-off type of lottery tickets lead to debris resulting from removal of the opaque scraped material which needs to be disposed-off and is a hassle for the user.

Applicant believes a related reference corresponds to U.S. Published Application Number 20090126135 (hereinafter '135 Published Application) which describes a scratch off tool for removing coverings from a lottery game piece has a body with a blade extending from the body. The blade is used to remove the scratch off covering from the game piece. The body is provided with an aperture to allow the tool to be attached to a key chain. Also, a magnifying glass is embedded within the body for use in reading the lottery game piece. Although the scratch off tool of the '135 Published Application can be employed for scratching of the lottery ticket, but such tool may not provide any means for convenient removal of the scraped off material from the lottery ticket.

Accordingly, there exists a need in the art to provide a tool which can be used for scratching off the lottery ticket as well as provide means for removal of the scraped off material from the lottery ticket. Other documents describing the closest subject matter provide for a number of more or less complicated features that fail to solve the problem in an efficient and economical way. None of these patents suggest the novel features of the present invention.

SUMMARY OF THE INVENTION

It is one of the main objectives of the present invention to provide a lottery ticket scratching tool which can be used conveniently and effectively for scraping of opaque material covering on a lottery ticket.

It is another objective of the present invention to provide a lottery ticket scratching tool for scraping of a lottery ticket without making any mess.

It is yet another objective of the present invention to provide a lottery ticket scratching tool which is simple in design, portable and easy to handle.

It is still another objective of the present invention to provide a lottery ticket scratching tool which is inexpensive to manufacture, rugged in construction and efficient in operation.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In some instances, well-known structures, processes and functions have not been shown or described in detail to avoid unnecessarily obscuring the description of the embodiments.

It shall be noted that unless the context clearly requires otherwise, throughout the description, the words "comprise," "comprising," "include," "including," and the like are to be construed in an inclusive sense as opposed to an exclusive or exhaustive sense; that is to say, in the sense of "including, but not limited to." Words using the singular or plural number also include the plural or singular number, respectively while adhering to the concepts of the present invention. Furthermore, references to "one embodiment" and "an embodiment" are not intended to be interpreted as excluding the existence of additional embodiments that also incorporate the recited features.

Figure 1:
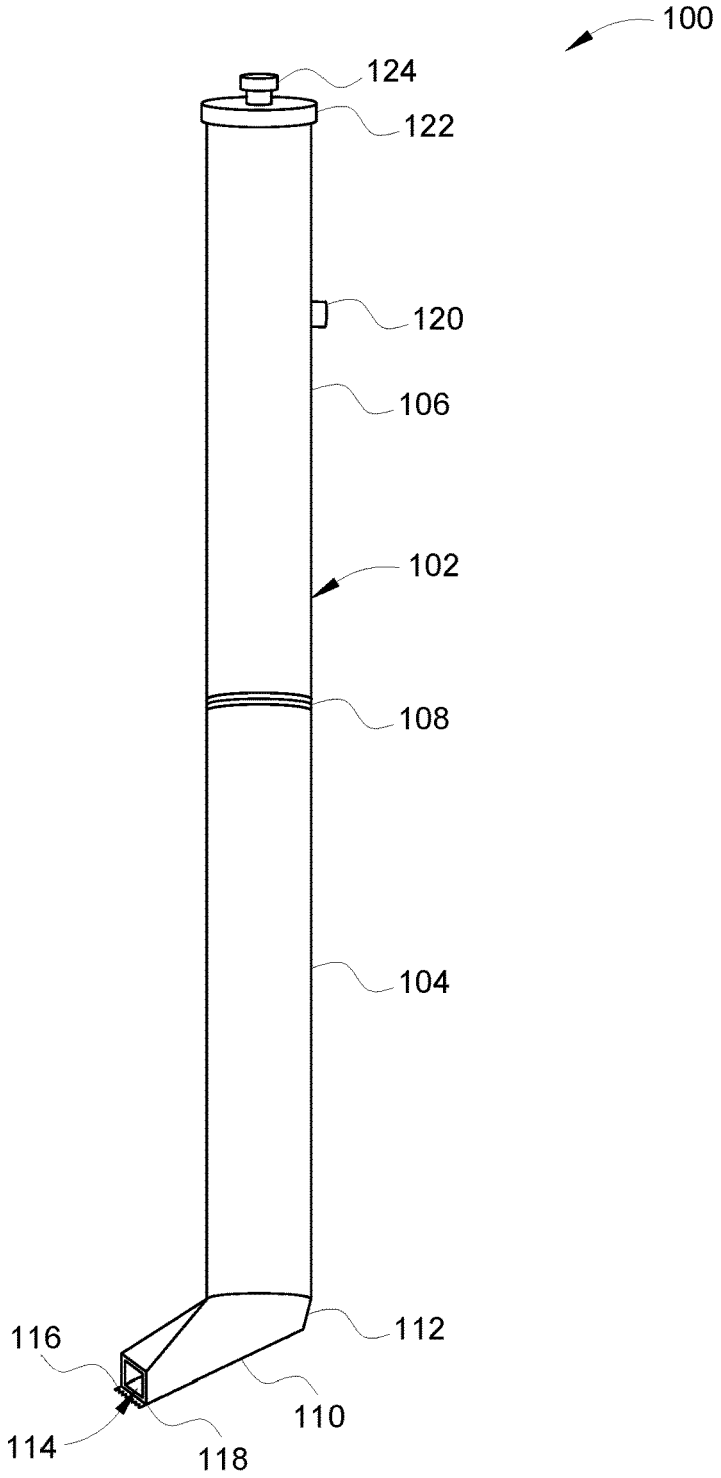
FIG. 1 illustrates a diagrammatic view of a lottery ticket scratching tool 100 with a scraping blade 116, in accordance with one or more embodiments of the present invention.

Referring now to the drawings, FIG. 1 illustrates a diagrammatic view of a lottery ticket scratching tool (hereinafter, simply referred to as scratching tool and referred by the numeral 100), in accordance with one or more embodiments of the present invention. As illustrated, the scratching tool 100 is, generally, adapted and designed in the shape of an elongate cylindrical member, for example, like a pen, for convenient and ergonomic handling by a user. The scratching tool 100 is envisioned in its preferred embodiment as a scraper means for scraping of opaque covering material on the lottery tickets. In this respect, it is to be understood that the present invention is not limited in its application to the scraping of the lottery tickets and to the arrangements of the components set forth in the following description or illustrated in the drawings. The invention is capable of other embodiments and of being practiced and carried out in various ways.

The scratching tool 100 has a main body 102 with a hollow cylindrical configuration. In an example, the main body 102 has a length of about 5-6 inches and a diameter of about ⅛ to ⅙ inches; however, the given dimensions shall not be construed as limiting to the disclosure in any manner. In one or more examples, the main body 102 may be formed of any suitable material, for example plastic or metallic materials, like aluminum, stainless steel, etc. In an embodiment, the main body 102 is divided into two sections, a lower section 104 and an upper section 106. The lower section 104 and the upper section 106 may be connected to each other (discussed later) at a junction 108. Further, the scratching tool 100 has a lower member 110 which is extending from the lower section 104 of the main body 102. In the illustrated embodiments, the lower member 110 is shown to be a bent manner extending at an angle from the lower section 104 from a boundary area 112 thereof. It may be understood that although the lower member 110 is shown to be bent with respect to the lower section 104 of the main body 102; in other examples, the lower member 110 may be extending in a straight manner from the lower section 104 without any limitations. As illustrated, the lower member 110 provides an intake port 114 at opposing end from the boundary area 112.

In an embodiment, as illustrated in FIG. 1, the scratching tool 100 includes a scraping blade 116 extending from the lower member 110. The scraping blade 116 may be made of any suitable materials, such as plastic or metal. For example, the scraping blade 116 may be made of the same material as the main body 102 to ease the manufacture of the scratching tool 100 but does not necessarily have to be so. It may be seen that the scraping blade 116 particularly extend from a bottom edge 118 of the intake port 114 in the lower member 110. As shown, the intake port 114 is located at the front of the scratching tool 100, and the scraping blade 116 is extending therefrom. As may be contemplated that the scraping blade 116 may have a serrated edge with a bevel at an end thereof. The bevel provides a surface which will lie flat against the lottery ticket when the main body 102 is at an angle to the ticket, increasing the comfort and ease in using the scratching tool 100. Also, the scratching tool 100 includes a power button 120 provided on the main body 102, and configured to switch ON and OFF the scratching tool 100 (discussed later), as desired. In some examples, the power button 120 may be in the form of a squeeze mechanism provided on the main body 102 which could be once pressed to switch ON and then pressed again to switch OFF the scratching tool 100.

Further, as illustrated in FIG. 1, the scratching tool 100 includes a cap 122 provided at a top end of the upper section 106. The cap 122 may be engaged with the upper section 106 by means of threads (discussed later). It may be understood that the cap 122 may be unscrewed from the upper section 106 to access the inside thereof. Further, the cap 122 may be provided with a knob 124 or the like to allow a user to easily rotate the cap for screwing and unscrewing from the upper section 106, when required. In an embodiment, the knob 124 may be designed in order to allow a lucky charm (not shown) to be attached thereto and supported thereon. In other examples, the knob 124 may altogether be replaced with the lucky charm. For instance, the lucky charm may be screwed on to the cap 122. The lucky charm may come in various sizes and shapes, such as in the shape of heart, dice, four-leaf clover, emoji, or any other shape of the liking of the user.

Figure 2:
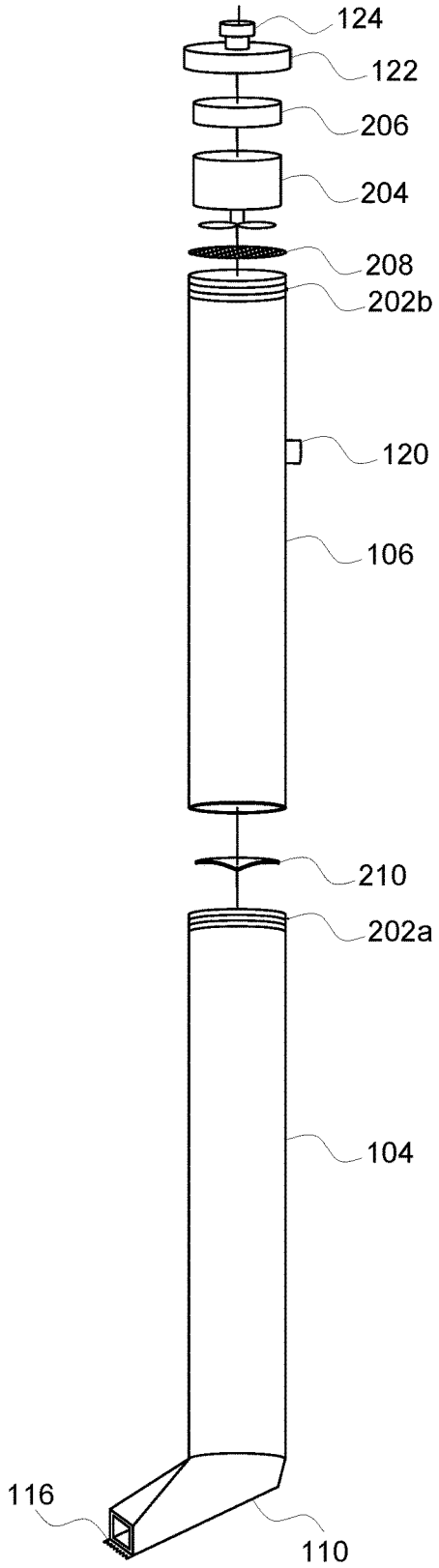
FIG. 2 illustrates an exploded diagrammatic view of the lottery ticket scratching tool 100 showing its internal components including an electric motor 204 for generating vacuum therein, in accordance with one or more embodiments of the present invention.

FIG. 2 illustrates an exploded view of the scratching tool 100, in accordance with one or more embodiments of the present invention. As may be contemplated from FIG. 2, the lower section 104 and the upper section 106 may be engaged by means of threads (only threads 202*a* of the lower section 104 are shown in FIG. 2). Further, the cap 122 may be engaged with the upper section 106 by means of threads (only threads 202*b* of the upper section 106 are shown in FIG. 2). As illustrated, the scratching tool 100 includes an electric motor 204 generally adapted to be located inside the upper section 106 of the main body 102. The electric motor 204 is configured to generate vacuum inside the main body 102 in order to suck air via the intake port 114 in the lower member 110 thereof. In one or more examples, the electric motor 204 may be a 4.2 Volt D.C. motor of about 16 mm diameter which is well known in the art and widely available in the markets. Such electric motor 204 may be able to generate rpm of about 400 to 50000. It may be understood that the electric motor 204 may be engaged with an impeller (not shown) or the like to be able to generate vacuum, as required.

In an embodiment, the scratching tool 100 may be a battery operated tool. For that purpose, the scratching tool 100 includes a battery 206 disposed in electric connection with the electric motor 204 to provide electric power thereto. In particular, the battery 206 may be connected to the power button 120; and provide electric power to the electric motor 204 when the power button 120 is in switched ON configuration. Such arrangement for controlling an electric device is well known in the art and have not been described in detail herein. The battery 206 may include one or more of button cells, AAA batteries, and the like. It may be contemplated that when the battery 206 needs to be replaced, the cap 122 may be unscrewed to access compartment adapted for holding the battery 206 inside the main body 102.

Further, as illustrated in FIG. 2, the scratching tool 100 may include a fine mesh 208 provided below the electric motor 204 in the main body 102 to filter the air being sucked before impinging on the electric motor 204. It may be understood that the main body 102 may be provided with a discharge port (not shown), for example, in the cap 122, to expel the sucked air back into the atmosphere. That is, at least one air discharge port is provided in fluid communication with the intake port 114, such as formed by penetrating the main body 102. In some examples, the scratching tool 100 may further be provided with a one-way valve 210 disposed inside the main body 102, which is located between the intake port 114 and the electric motor 204. The one-way valve 210 may ensure that the debris material collected along with the sucked air is not discharged or expelled back from the intake port 114, when the electric motor 204 is switched OFF. In one or more examples, the one-way valve 210 may be a butterfly valve or a weighted flapper which are well known in the art.

In operation, the scratching tool 100 is switched ON by pressing the power button 120. When switched ON, the electric current from the battery 206 is supplied to power the electric motor 204, thereby creating vacuum inside the main body 102. At this stage, the user may implement the scratching tool 100 to scratch-off a lottery ticket. The user may scrape the scraping blade 116 against the opaque covering to be removed from the lottery ticket in order to reveal the underlying covered information. The resultant debris from the scratching would be sucked into the main body via the intake port 114 due to the vacuum inside the main body 102. The sucked debris would be collected in the lower section 104 of the main body 102. The collected debris stay in the lower section 104 due to the arrangement of the one-way valve 210. Further, the fine mesh 208 prevent the debris to impinge on and damage the electric motor 204 and other electric components of the scratching tool 100. Once the lottery ticket has been sufficiently scratched, and/or the lower section 104 is filled with the collected debris material, the lower section 104 may be unscrewed from the upper section 106, and the collected debris may be dumped, for example into a bowl, plastic cup, bin, or the like.

The scratching tool 100 of the present invention is utilized to replace knives, coins, or fingernails utilized in the scraping of the lottery tickets. The scratching tool 100 provides for convenient and proper scratching of the lottery tickets due to its ergonomic and functional design. The beveled scraping blade 116 ensures proper scraping of the lottery ticket without damaging the paper and the underlying identifying information of the lottery ticket. The generated vacuum sucks the scraped off debris material, thus ensuring no mess is created in the whole scratching process of the lottery ticket.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A lottery ticket scratch off tool, comprising:

a main body having a lower section and upper section connected to each other at a junction, said upper section being vertical and said lower section extending diagonally therefrom, said upper section has a circumference, said lower section has a lower distalmost end having an opening being an intake port surrounded by perimeter edges, one of the perimeter edges includes a scraping blade, a motor housed inside said upper section powering a vacuum housed within said upper section, said vacuum adapted to suction debris through said intake port, and an upper opening being a discharge port where the suctioned air escapes from said scratch off tool, said upper section has an upper distalmost end having an upper opening covered by a cap, a knob mounted entirely above said cap configured to rotatably open and close said cap, said motor being adjacent and below said cap, said scraping blade being entirely outside said circumference.

2. The scratch off tool of claim 1 wherein said main body has a hollow cylindrical configuration.

3. The scratch off tool of claim 1 wherein said perimeter edges include a top and bottom perimeter edge, said bottom perimeter edge having a scraping tool.

4. The scratch off tool of claim 1 wherein said scraping blade is serrated.

5. The scratch off tool of claim 1 wherein said scraping blade includes a bevel.

6. The scratch off tool of claim 1 having a power button that turns on and off the motor.

7. The scratch off tool of claim 1 wherein said motor is electric.

8. The scratch off tool of claim 1 wherein said motor is powered using a battery.

9. The scratch off tool of claim 1 wherein said upper section includes a mesh filter between a one-way valve located within said upper section and said electric motor.

10. The scratch off tool of claim 1 wherein said motor is mounted to said cap.

* * * * *